US008001653B1

(12) United States Patent
Longley et al.

(10) Patent No.: US 8,001,653 B1
(45) Date of Patent: Aug. 23, 2011

(54) VACUUM APPARATUS

(76) Inventors: Everton W. Longley, Mississauga (CA); Michelle Longley, Mississauga (CA)

( * ) Notice: Subject to any disclaimer, the term of this patent is extended or adjusted under 35 U.S.C. 154(b) by 84 days.

(21) Appl. No.: 12/478,453

(22) Filed: Jun. 4, 2009

(51) Int. Cl.
*A47L 9/28* (2006.01)

(52) U.S. Cl. ..... 15/367; 15/403; 15/DIG. 8

(58) Field of Classification Search ..... 15/367, 15/403, DIG. 1, DIG. 8; *A47L 9/28*
See application file for complete search history.

(56) References Cited

U.S. PATENT DOCUMENTS

| | | | | |
|---|---|---|---|---|
| 3,790,987 | A | 2/1974 | MacFarland | |
| 4,835,409 | A | 5/1989 | Bhagwat et al. | |
| 5,020,186 | A | 6/1991 | Lessig, III et al. | |
| 5,035,024 | A | 7/1991 | Steiner et al. | |
| 5,115,538 | A | 5/1992 | Cochran et al. | |
| 5,560,077 | A * | 10/1996 | Crotchett | 15/339 |
| D430,961 | S | 9/2000 | Bobrosky et al. | |
| 6,311,366 | B1 | 11/2001 | Spke et al. | |
| 6,536,073 | B2 * | 3/2003 | Uratani et al. | 15/327.4 |
| 6,684,451 | B2 * | 2/2004 | Kato et al. | 15/319 |
| 6,763,548 | B1 | 7/2004 | Birle et al. | |
| 2002/0121000 | A1 * | 9/2002 | Tyler | 15/412 |

* cited by examiner

*Primary Examiner* — David A Redding

(57) ABSTRACT

A vacuum apparatus includes a housing that includes a vacuum assembly with a base. A rechargeable battery is mounted within the vacuum assembly and is electrically coupled to the blower of the vacuum assembly which creates suction through the base when the blower is turned on. A plurality of first mating charge contacts is mounted on the housing and are electrically coupled to the battery. The first mating charge contacts are engageable with second mating charge contacts mounted in an upper surface of a charging station. A power cord is electrically coupled to the second mating charge contacts to supply power to the second mating charge contacts. The battery is charged when the first and second mating charge contacts abut each other and the power cord is plugged into an electrical power source.

4 Claims, 7 Drawing Sheets

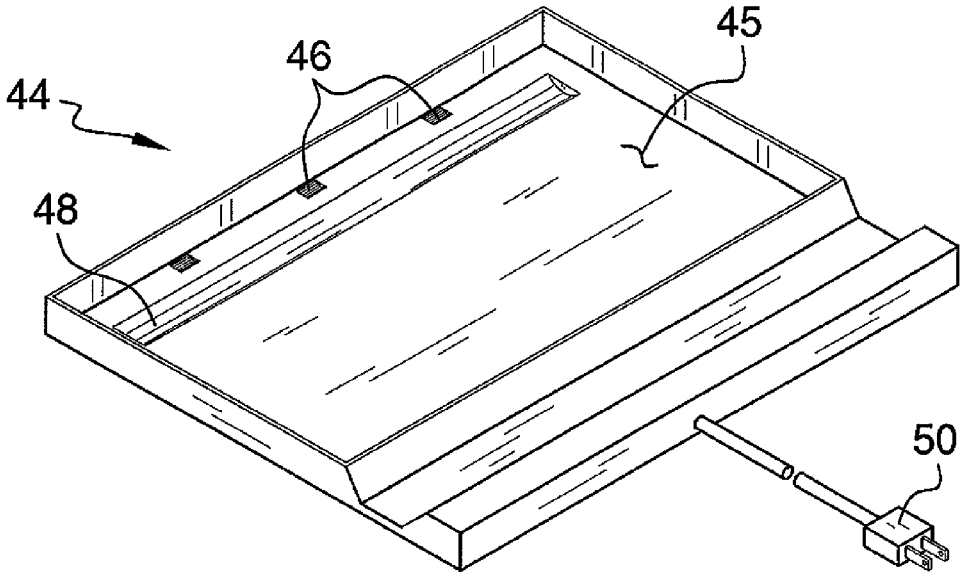
FIG. 6
FIG. 7
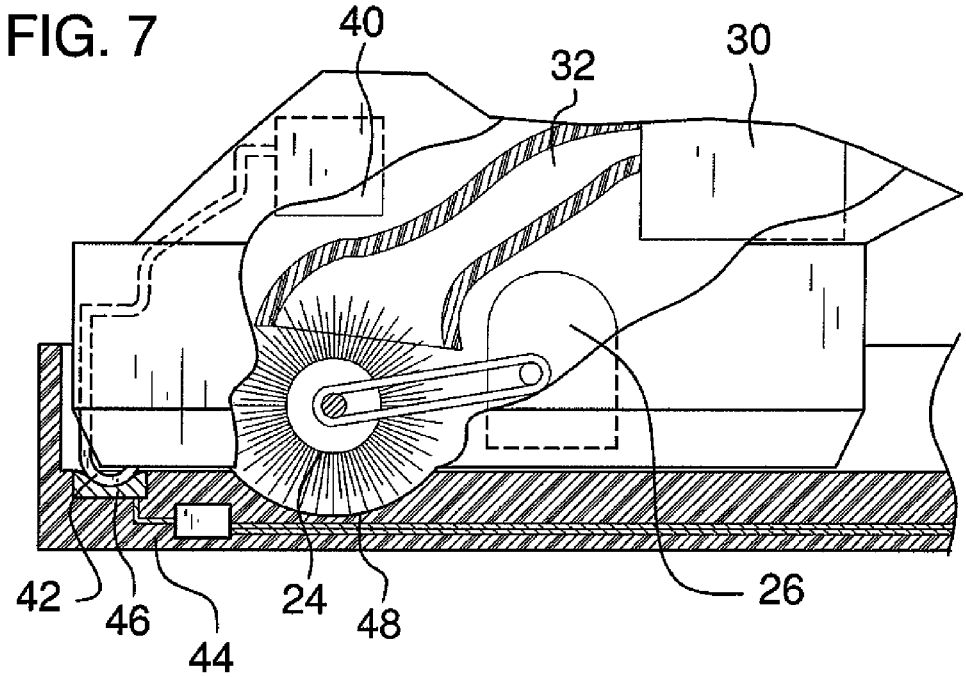

VACUUM APPARATUS

BACKGROUND OF THE DISCLOSURE

Field of the Disclosure

The disclosure relates to vacuum devices and more particularly pertains to a new vacuum device allowing for usage while not plugged into an electrical outlet.

SUMMARY OF THE DISCLOSURE

An embodiment of the disclosure meets the needs presented above by generally comprising a housing that includes a base having a top wall and a perimeter wall that is attached to and extends downwardly from the top wall. A plurality of wheels is attached to the base and extends downwardly from the perimeter wall. An upper compartment is attached to and extends upwardly from the top wall. The housing contains a blower to create suction through a conduit extending through the base to suction material from a floor surface positioned beneath the base. A handle is attached to and extends upwardly from the housing. A trap is in fluid communication with the conduit to retain material suctioned into the conduit. A rechargeable battery is mounted within the housing. The battery is electrically coupled to the blower. A plurality of first mating charge contacts is mounted on the housing and is electrically coupled to the battery. The first mating charge contacts are positioned adjacent to a bottom edge of the perimeter wall. A charging station includes an upper surface having a plurality of second mating charge contacts positioned thereon. The second mating charge contacts each are positioned to engage one of the first mating charge contacts when the base is positioned on the upper surface. A power cord is electrically coupled to the second mating charge contacts to supply power to the second mating charge contacts. The battery is charged when the first and second mating charge contacts abut each other and the power cord is plugged into an electrical power source.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein:

FIG. 6 is a top perspective view of a charging station of an embodiment of the disclosure.

FIG. 7 is a side broken view of an embodiment of the disclosure.

DESCRIPTION OF THE PREFERRED EMBODIMENT

Figure 1:
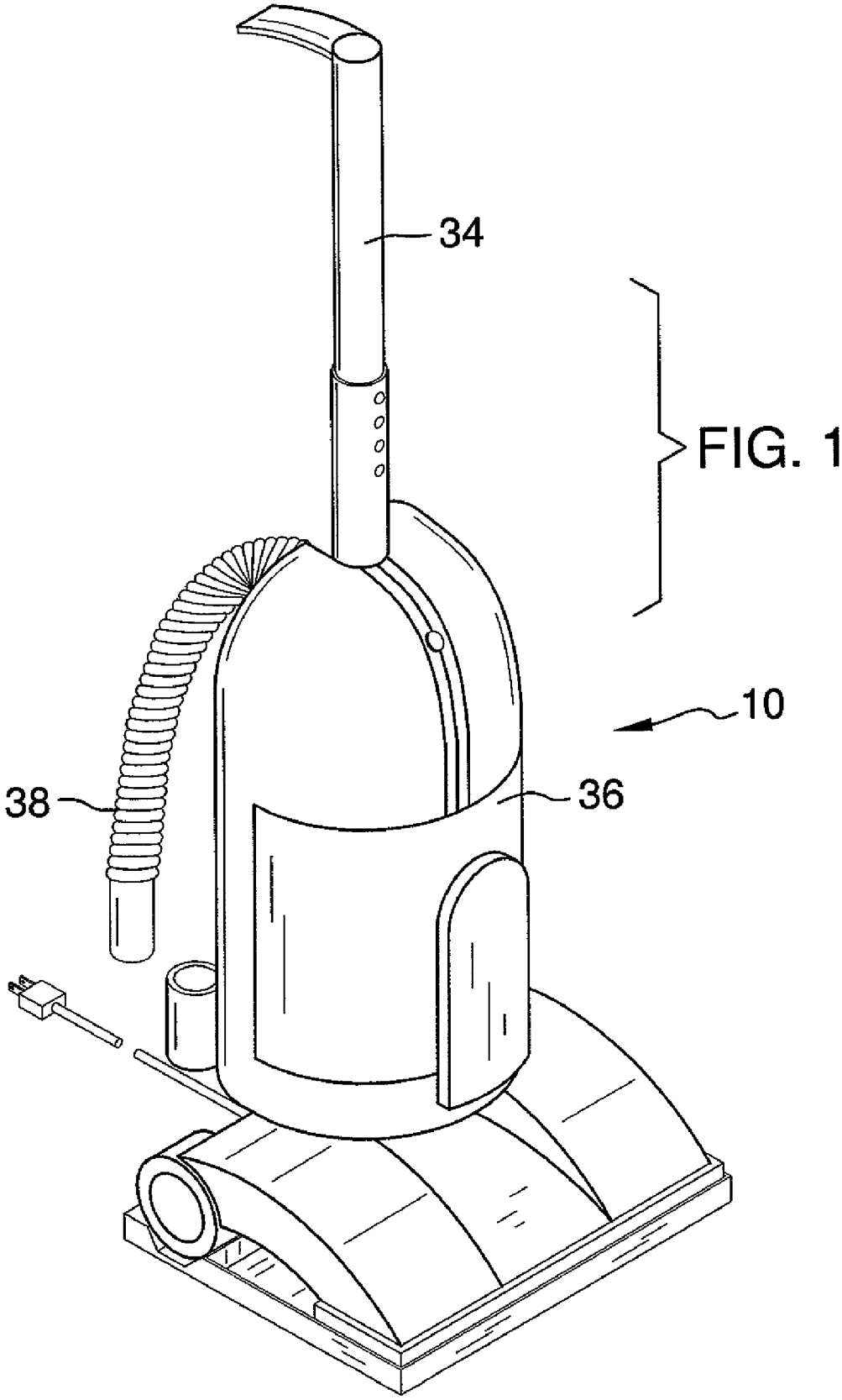
FIG. 1 is a top perspective view of a vacuum apparatus according to an embodiment of the disclosure.
Figure 2:
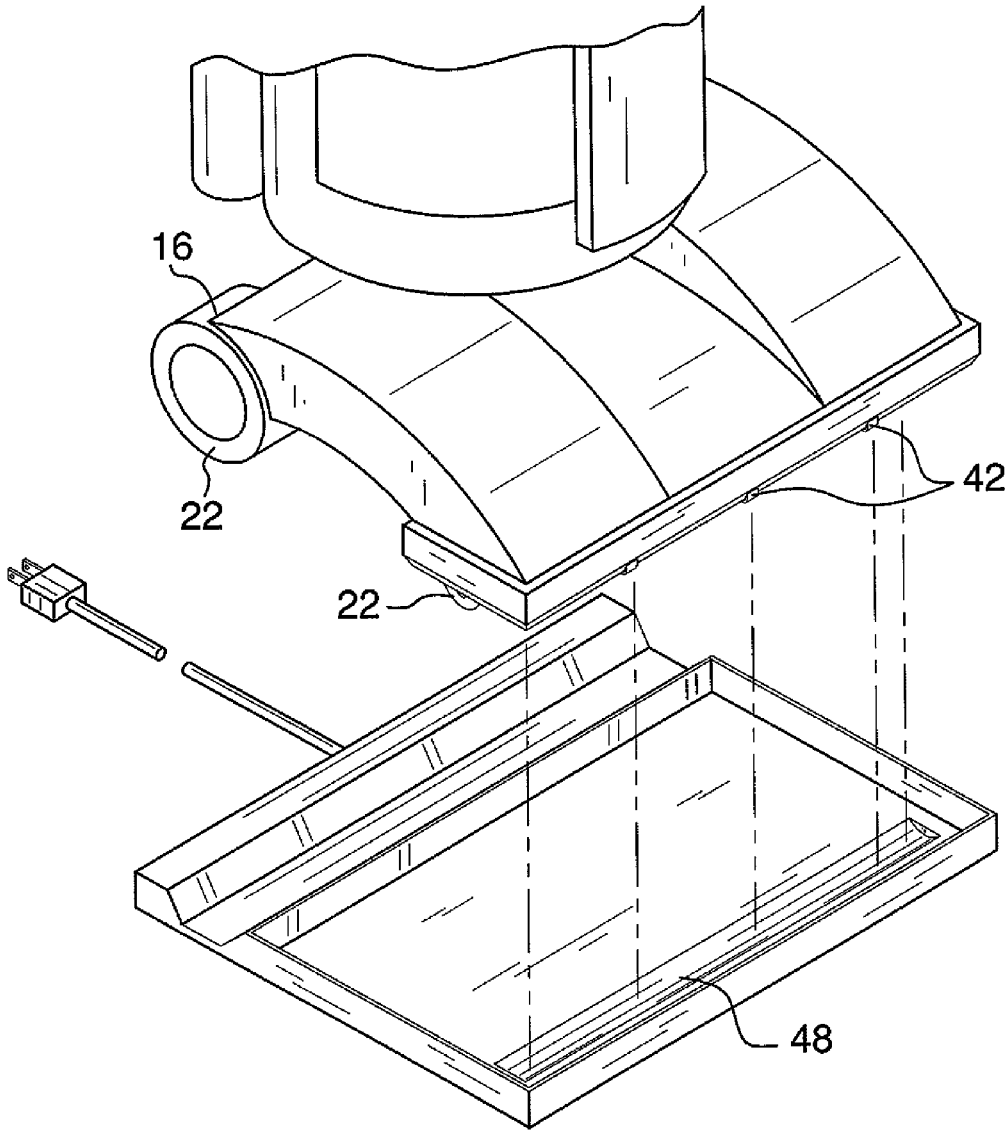
FIG. 2 is a top perspective view of an embodiment of the disclosure.
Figure 3:
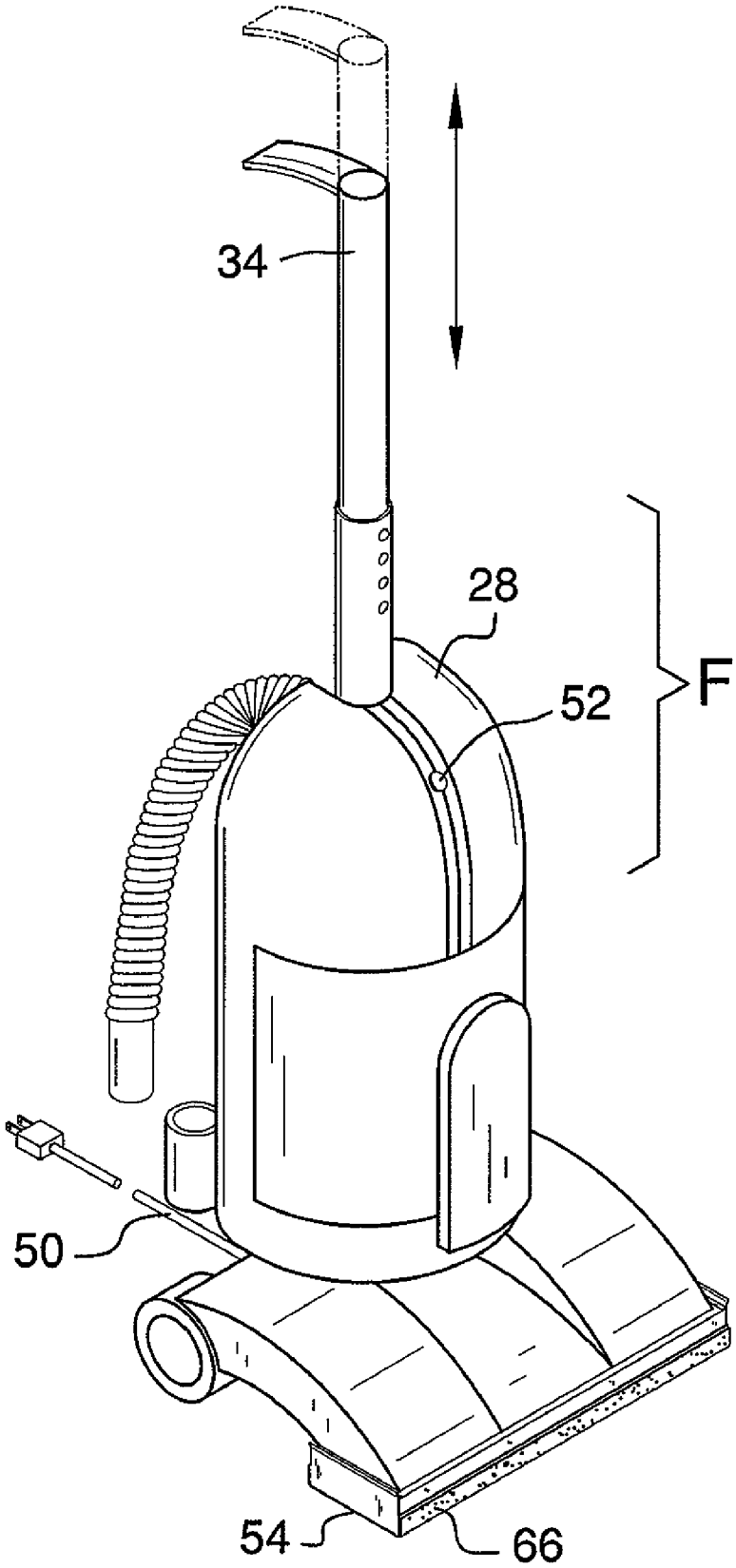
FIG. 3 is a top perspective view of an embodiment of the disclosure.
Figure 4:
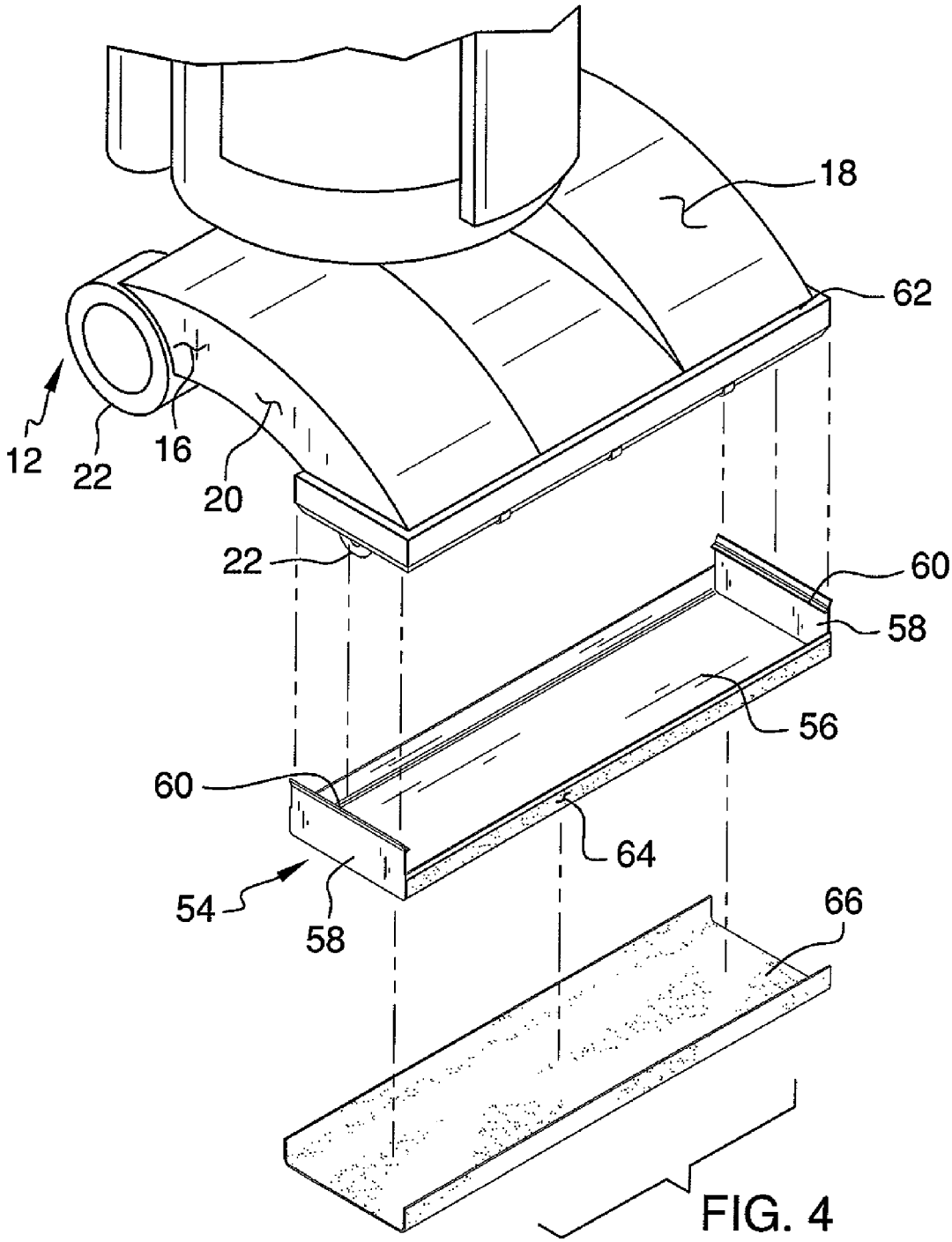
FIG. 4 is a top perspective view of an embodiment of the disclosure.
Figure 5:
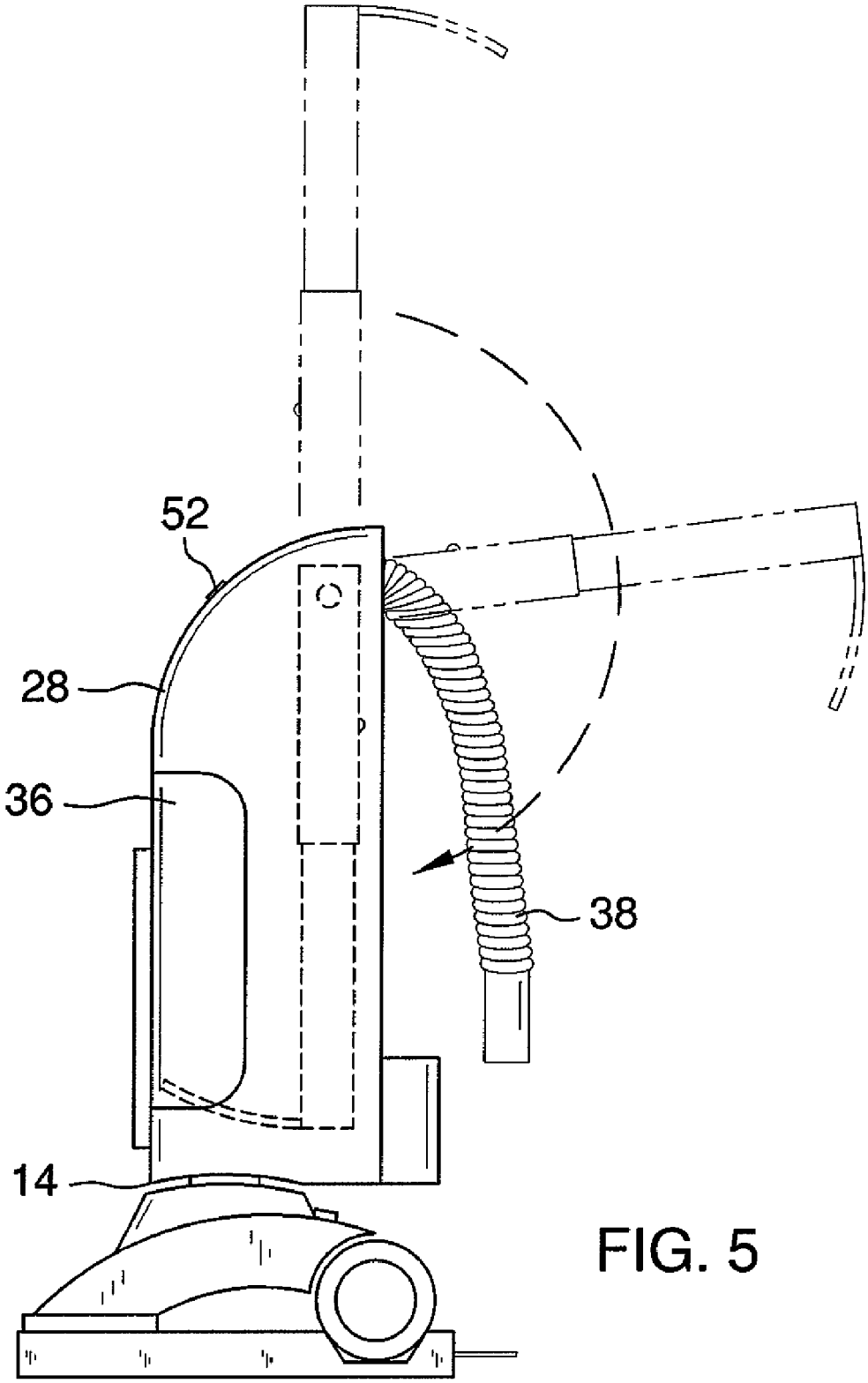
FIG. 5 is a side view of an embodiment of the disclosure.
Figure 8:
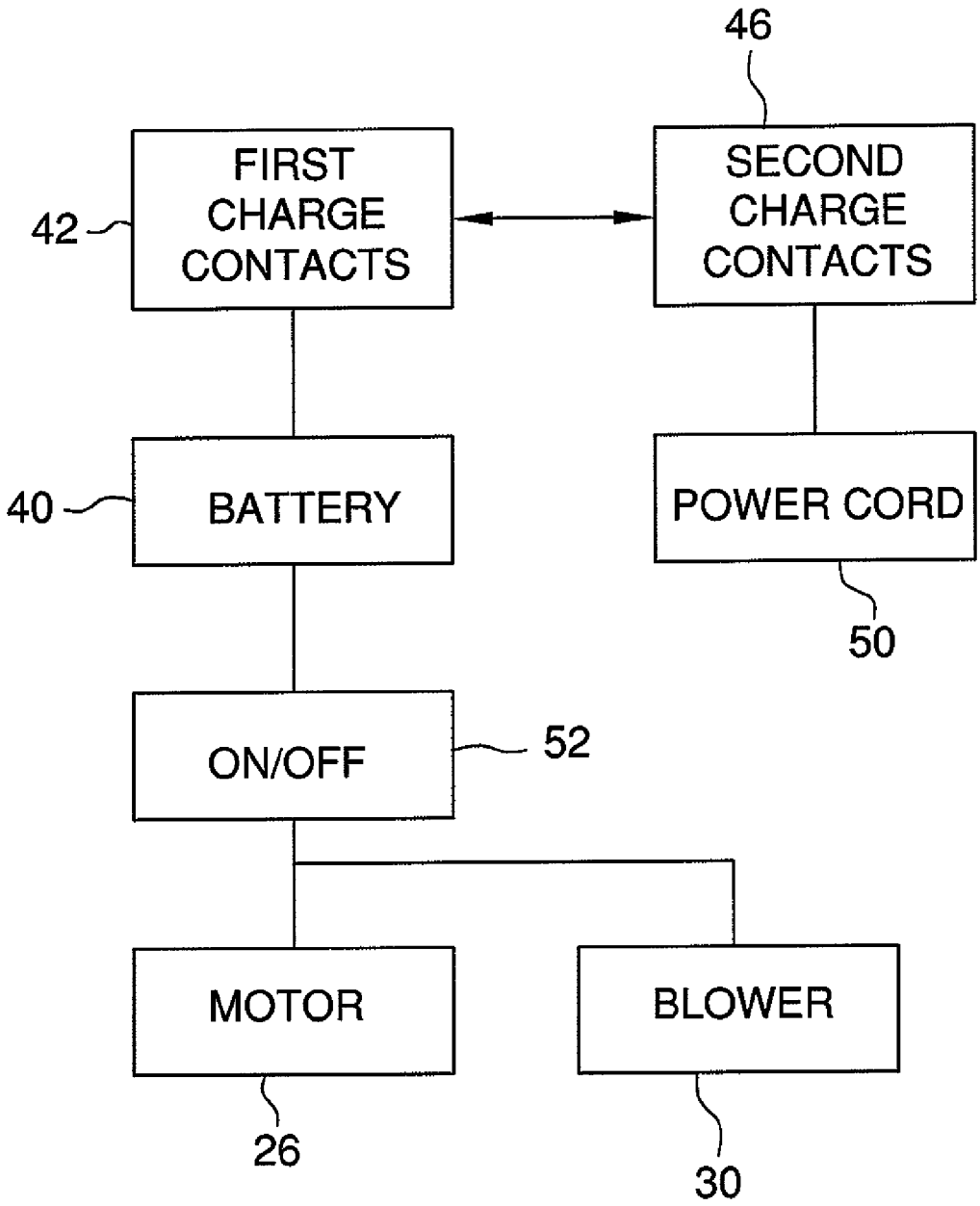
FIG. 8 is a schematic view of an embodiment of the disclosure.

With reference now to the drawings, and in particular to FIGS. 1 through 8 thereof, a new vacuum device embodying the principles and concepts of an embodiment of the disclosure and generally designated by the reference numeral 10 will be described.

As best illustrated in FIGS. 1 through 8, the vacuum apparatus 10 generally comprises a conventional vacuum assembly 12 including a housing 14 with a base 16 having a top wall 18 and a perimeter wall 20 attached to and extending downwardly from the top wall 18. A plurality of wheels 22 is attached to the base and extends downwardly form the perimeter wall 20. A brush assembly 24 may be rotatably mounted to the base 16 and a motor 26 is mounted in the base 16 and mechanically coupled to the brush assembly 24. The motor 26 rotates the brush assembly 24 when the motor 26 is turned on. An upper compartment 28 is attached to and extends upwardly from the top wall 18. The housing 14 contains a blower 30 to create suction through a conduit 32 extending through the base 16 to suction material from a floor surface positioned beneath the base 16. A handle 34, which may be telescopic, is attached to and extends upwardly from the housing 14 and may be pivotally couple dto the housing 14. A trap 36 is in fluid communication with the conduit 32 to retain material suctioned into the conduit 32. The conduit 32 includes a removable and flexible hose section 38. The motor 26, brush assembly 24, blower 30, conduit 32 and trap 36 are all conventional and may comprise any conventional components of a traditional vacuum cleaner.

The apparatus 10 is directed also to a rechargeable battery 40 that is mounted within the housing 14. The battery 40 is electrically coupled to the blower 30 and to the motor 26. A plurality of first mating charge contacts 42 are mounted on the housing 14 and are electrically coupled to the battery 40. The first mating charge contacts 42 are positioned adjacent to a bottom edge of the perimeter wall 20. A charging station 44 includes an upper surface having a plurality of second mating charge contacts 46 positioned thereon. The second mating charge contact 46s each are positioned to engage one of the first mating charge contacts 42 when the base 16 is positioned on the upper surface 45. The upper surface 45 has at least one wheel engaging member 48 to engage at least one of the wheels 22 of the housing 14 to retain the housing 14 on the charging station 44. The at least one wheel engaging member 48 may include a rear trough for receiving rear wheels and a front trough for receiving front wheels and the brush assembly 24.

A power cord 50 is electrically coupled to the second mating charge contacts 46 to supply power to the second mating charge contacts 46. The battery 40 is charged when the first 42 and second 46 mating charge contacts abut each other and the power cord 50 is plugged into an electrical power source. In this way, the vacuum assembly 12 need not be plugged into a wall outlet while being used. An actuator 52 is electrically coupled to the battery 40. The actuator 52 is moved to an on position to turn on the blower 30 and the motor 26 or to an off position to turn the blower 30 and the motor 26 off.

A covering 54 is removably positionable over the base 16 adjacent to a front edge of the base 16. The covering 54 includes a plate 56 and a pair of side walls 58 that are attached to and extends upwardly from the plate 56. A pair of flanges 60 is provided. Each of the side walls 58 has one of the flanges 60 attached thereto. The flanges 60 are releasably engageable with a ridge 62 positioned on the perimeter wall 20 to retain the plate 56 adjacent to the bottom edge of the perimeter wall 20. The plate 56 covers front ones of the wheels 22 and the brush assembly 48. A polishing cloth 66 is removably coupled to and covers a bottom side of the covering 54 to allow the housing 14 to be used to move the cloth 66 across a floor surface and polish the floor with the polishing cloth 66. The cloth 66 may be attached to the covering 54 with conventional means such as hook and loop fasteners 64.

In use, the vacuum assembly 12 is used in a conventional manner to vacuum floors, rugs and other walking surfaces. However, the battery 40 allows the vacuum assembly 12 to be used without being plugged into a wall outlet. Further, the apparatus 10 provides for a floor polishing cloth 66 and covering 54 to allow the vacuum assembly 12 to also be used to polish wooden floors.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A vacuum assembly including:

a housing including a base having a top wall and a perimeter wall being attached to and extending downwardly from said top wall, a plurality of wheels being attached to said base and extending downwardly form said perimeter wall, an upper compartment being attached to and extending upwardly from said top wall, said housing containing a blower to create suction through a conduit extending through said base to suction material from a floor surface positioned beneath said base, a handle being attached to and extending upwardly from said housing, a trap being in fluid communication with said conduit to retain material suctioned into said conduit;

a rechargeable battery being mounted within said housing, said battery being electrically coupled to said blower;

a plurality of first mating charge contacts being mounted on said housing and being electrically coupled to said battery, said first mating charge contacts being positioned adjacent to a bottom edge of said perimeter wall;

a charging station including an upper surface having a plurality of second mating charge contacts positioned thereon, said second mating charge contacts each being positioned to engage one of said first mating charge contacts when said base is positioned on said upper surface;

a power cord being electrically coupled to said second mating charge contacts to supply power to said second mating charge contacts, said battery being charged when said first and second mating charge contacts abut each other and said power cord is plugged into an electrical power source;

a covering being removably positionable over said base adjacent to a front edge of said base; and a polishing cloth being removably coupled to and covering a bottom side of said covering to allow said housing to be used to move said cloth across a floor surface and polish the floor with said polishing cloth.

2. The assembly according to claim 1, wherein said upper surface of said charging station has at least one wheel engaging member to engage at least one of the wheels of said housing to retain said housing on said charging station.

3. The assembly according to claim 1, wherein said covering includes:

a plate;

a pair of side walls being attached to and extending upwardly from said plate; and a pair of flanges, each of said side walls having one of said flanges attached thereto, said flanges being releasably engageable with a ridge positioned on said perimeter wall to retain said plate adjacent to said bottom edge of said perimeter wall.

4. A vacuum assembly including:

a housing including a base having a top wall and a perimeter wall being attached to and extending downwardly from said top wall, a plurality of wheels being attached to said base and extending downwardly form said perimeter wall, a brush assembly being rotatably mounted to said base and a motor being mounted in said base and mechanically coupled to said brush assembly, said motor rotating said brush assembly when said motor is turned on, an upper compartment being attached to and extending upwardly from said top wall, said housing containing a blower to create suction through a conduit extending through said base to suction material from a floor surface positioned beneath said base, a handle being attached to and extending upwardly from said housing, a trap being in fluid communication with said conduit to retain material suctioned into said conduit, said conduit including a removable and flexible hose section;

a rechargeable battery being mounted within said housing, said battery being electrically coupled to said blower and to said motor;

a plurality of first mating charge contacts being mounted on said housing and being electrically coupled to said battery, said first mating charge contacts being positioned adjacent to a bottom edge of said perimeter wall;

a charging station including an upper surface having a plurality of second mating charge contacts positioned thereon, said second mating charge contacts each being positioned to engage one of said first mating charge contacts when said base is positioned on said upper surface, said upper surface having at least one wheel engaging member to engage at least one of the wheels of said housing to retain said housing on said charging station;

a power cord being electrically coupled to said second mating charge contacts to supply power to said second mating charge contacts, said battery being charged when said first and second mating charge contacts abut each other and said power cord is plugged into an electrical power source;

an actuator being electrically coupled to said battery, said actuator being moved to an on position to turn on said blower and said motor or to an off position to turn said blower and said motor off;

a covering being removably positionable over said base adjacent to a front edge of said base, said covering including;

a plate;

a pair of side walls being attached to and extending upwardly from said plate;

a pair of flanges, each of said side walls having one of said flanges attached thereto, said flanges being releasably engageable with a ridge positioned on said perimeter wall to retain said plate adjacent to said bottom edge of said perimeter wall; and a polishing cloth being removably coupled to and covering a bottom side of said covering to allow said housing to be used to move said cloth across a floor surface and polish the floor with said polishing cloth.

* * * * *